US005317827A

United States Patent [19]

Jaremco

[11] Patent Number: 5,317,827

[45] Date of Patent: Jun. 7, 1994

[54] BORE JAG

[75] Inventor: Kenneth B. Jaremco, Surrey, Canada

[73] Assignee: RTI Research Ltd., Surrey, Canada

[21] Appl. No.: 941,889

[22] Filed: Sep. 8, 1992

[51] Int. Cl.[5] ..... F41A 29/02

[52] U.S. Cl. ..... 42/95; 15/104.165

[58] Field of Search ..... 15/104.16, 104.165, 15/104.2; 42/95

[56] References Cited

U.S. PATENT DOCUMENTS

| | | | |
|---|---|---|---|
| 1,080,679 | 12/1913 | Cook | 15/104.165 |
| 1,256,478 | 2/1918 | Hansen | 15/104.165 |
| 1,665,988 | 4/1928 | Smith | 15/104.165 |
| 3,609,790 | 10/1971 | Butch | 15/104.165 |
| 4,499,625 | 2/1985 | Bottomley | 15/104.165 |
| 4,503,578 | 3/1985 | McIntyre | 15/104.165 |
| 5,204,483 | 4/1993 | Tellechea | 42/95 |

*Primary Examiner*—Stephen C. Bentley
*Attorney, Agent, or Firm*—Brian M. Long

[57] ABSTRACT

A bore jag, having a tapered tip at one end, the opposite end of the bore jag being releasibly connectible to an end of a barrel cleaning rod, and frusto-conical barbs distributed along the bore jag for retaining engagement with a cleaning cloth. A bore jag guide in the form of an O-ring extends around the bore jag for sliding engagement with the bore of a rifle barrel as the bore jag is drawn along the rifle barrel bore. The bore jag guide comprises a material which is sufficiently soft to avoid damage to the rifle barrel bore by the sliding engagement of the bore jag guide therewith, and the bore jag guide being so dimensioned as to support the remainder of the bore jag out of contact with the rifle barrel bore during the travel of the bore jag along the rifle barrel bore.

2 Claims, 1 Drawing Sheet

BORE JAG

BACKGROUND OF THE INVENTION

1. Field of the Invention

The present invention relates to rifle barrel cleaning devices, and, more particularly, to such devices known as bore jags.

Bore jags are rifle barrel cleaning devices which are secured to the end of a rod for insertion into the barrel of a rifle. In use of such bore jags, a cleaning cloth, impregnated with a suitable liquid, for example, oil or a special barrel cleaning liquid, is wrapped around the bore jag, which is provided at one end of a rod. This rod is then employed to push the bore jag, with the surrounding cleaning cloth, into and along the bore of a rifle barrel.

When possible, i.e., depending on the type of rifle being cleaned, the bore jag and its cleaning cloth are inserted into the rifle barrel from the breach end of the barrel. In other case, however, it is necessary to insert the bore jag and its cleaning cloth from the muzzle end of the barrel.

In the first case, the bore jag is usually pushed along the rifle barrel until it exits the barrel at the muzzle end, whereupon the cleaning cloth drops from the bore jag. The direction of movement of the rod is then reversed, to pull the bore jag back into the rifle barrel.

2. Description of Related Art

In cases where the bore jag is inserted into the rifle barrel of the muzzle end of the rifle barrel, then it is sometimes necessary to ensure that, when the direction of movement of the rod is subsequently reversed in order to move the bore jag back towards the muzzle end of the rifle barrel and, eventually, to remove the bore jag entirely from the rifle barrel, the cleaning cloth is retained on the bore jag, so that it does not remain in the rifle. For that purpose, prior art bore jags have been formed with a plurality of frusto-conical barbs, which are coaxial with the bore jag itself and which taper towards the front or leading end of the bore jag as the latter is initially advanced into the rifle barrel. These barbs serve to catch and retain the cleaning cloth, wrapped around the bore jag, when the bore jag is eventually withdrawn from the rifle barrel, so that the cleaning cloth is likewise withdrawn with the bore jag from the rifle barrel.

When such a bore jag is employed for the purpose of cleaning a rifle barrel as described above, then it is highly desirable to ensure that the bore jag does not scrape along the rifling of the rifle barrel, since such scraping would damage the rifling. Furthermore, in the cases when, as described above, the bore jag is inserted into the rifle barrel from the breach end until it eventually exists the opposite or muzzle end of the rifle barrel, it is highly desirable to ensure that the muzzle crown is not damaged by the barbs of the bore jag when the movement of the cleaning rod is reversed in order to draw the bore jag back into the rifle barrel past the muzzle crown.

BRIEF SUMMARY OF THE INVENTION

It is accordingly an object of the present invention to provide a novel and improved bore jag which substantially reduces the risk of damage to a rifle barrel by the bore jag during use of the bore jag.

According to the present invention, there is provided a bore jag comprising a tapered tip at one end of the bore jag, with means at the opposite end of the bore jag for releasibly connecting the bore jag to an end of a barrel cleaning rod. A plurality of barbs are distributed along the bore jag for retaining engagement with a cleaning cloth. A bore jag guide extends around the bore jag for sliding engagement with the bore of a rifle barrel as the bore jag is drawn along the rifle barrel bore. The bore jag guide comprises a material which is sufficiently soft to avoid damage to the rifle barrel bore by the sliding engagement of the bore jag guide therewith and the bore jag guide is so dimensioned as to support the remainder of the bore jag out of contact with the rifle barrel bore during the travel of the bore jag along the rifle barrel bore.

The bore jag guide thus serves the ensure that the barbs do not scrape along the rifling of the rifle barrel and damage the rifling, when the cleaning cloth is no longer wrapped around the barbs, so as to be interposed between the barbs and the rifle barrel bore.

In a preferred embodiment of the invention, the barbs are coaxially arranged, frusto-conically shaped barbs, and the bore jag guide is an O-ring of resilient material which is retained in a peripheral annular recess in the bore jag and which has an outer peripheral diameter greater than that of the frusto-conical barbs.

This O-ring resiliently spaces the outer peripheries of the frusto-conical barbs from the rifle bore surface when the bore jag is withdrawn from the rifle barrel with the cleaning cloth no longer wrapped around the bore jag and, therefore, no longer serving to protect the rifle barrel wall from damage by scraping of the outer peripheral edges of the frusto-conical barbs against the rifle barrel wall.

BRIEF DESCRIPTION OF THE DRAWING

Further features, objects and advantages of the present invention will be more readily apparent from the following description thereof when taken in conjunction with the accompanying drawing, in which.

DESCRIPTION OF THE PREFERRED EMBODIMENT

Figure 1:
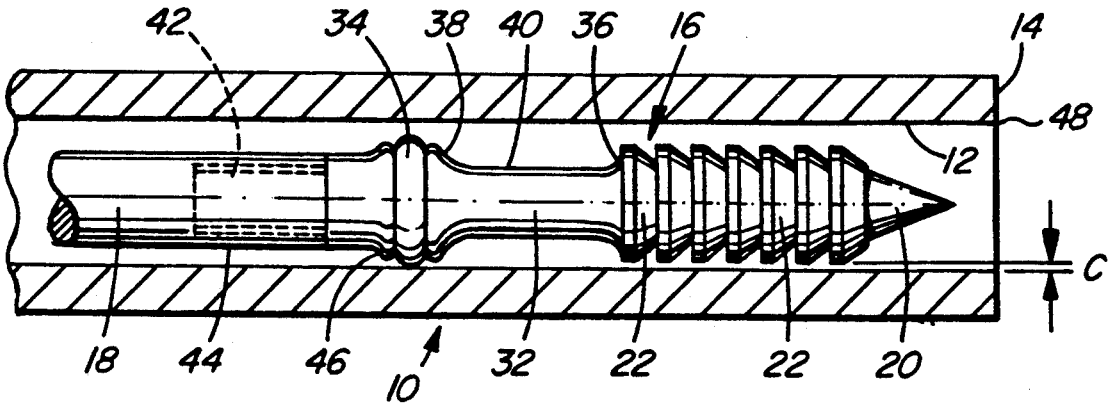
FIG. 1 shows a broken-away view, in longitudinal cross-section, through a rifle barrel muzzle containing a bore jag at one end of a cleaning rod.

FIG. 1 shows in longitudinal cross-section a broken-away portion of a rifle barrel indicated generally by reference numeral 10.

The rifle barrel 10 has a wall 12 and terminates at a muzzle crown 14.

A bore jag, which is indicated generally by reference numeral 16, is located within the bore 12 of the rifle barrel 10 and is secured to an end of a cleaning rod 18.

The bore jag 16 has, at one end thereof, a conical tip 20, which is followed by a series of seven coaxially aligned, frusto-conically shaped barbs 22.

Figure 3:
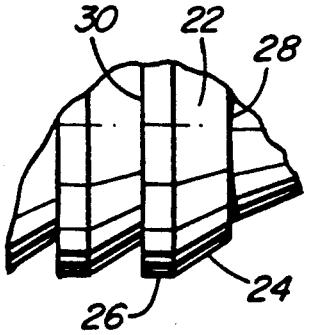
FIG. 3 shows a broken-away view, in side elevation, of parts of the bore jag of FIG. 1 on an enlarged scale.

The shape of the barbs 22 is illustrated in greater detail in FIG. 3, from which it can be seen that each barb 22 is defined by a frusto-conical surface 24, which diverges outwardly to a short, cylindrical surface 26. The surfaces 24 and 26 are peripheral surfaces extending between flat, annular surfaces 28 and 30 extending in planes transverse to the longitudinal axis of the bore jag 16.

The bore jag 16 also has a shank 32, which extends between the barbs 22 and a bore jag guide 34.

At opposite ends of the shank 32, the bore jag 16 has outwardly concavely curved, i.e. radiused portions 36 and 38. The concavely curved portion 36 merges smoothly with a cylindrical peripheral surface 40 of the shank 32 and diverges outwardly towards the cylindrical peripheral portion 26 of the adjacent barb 22. The concavely curved portion 38, which also merges smoothly with the cylindrical peripheral surface 40, diverges towards an outer peripheral portion of the bore jag guide 34.

Figure 2:
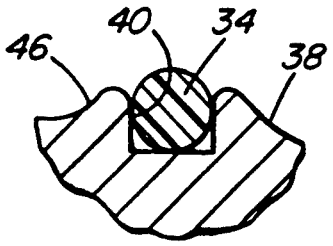
FIG. 2 shows a broken-away view, taken in section longitudinally of the bore jag of FIG. 1, showing in greater detail a bore jag guide and associated parts of the bore jag.

The bore jag guide 34 comprises an O-ring of elastomeric material, which is engaged in and retained by an annular peripheral recess 40, of rectangular cross-section, formed in the bore jag 16, as shown in FIG. 2.

As is also apparent from FIG. 2, and from FIG. 1, the outer peripheral portion of the O-ring forming the bore jag guide 34 projects radially outwardly from the annular recess 40. The outer diameter of this peripheral portion of the bore jag guide 34 is greater than the outer diameters of all other parts of the bore jag 16, and in particular, is greater than the diameters of the cylindrical peripheral portions 26 of the barbs 22.

Consequently, when the bore jag 16 is drawn through the barrel bore 12 without its cleaning cloth, this outer peripheral portion of the bore jag guide 34 slides in contact the internal surface of the rifle barrel bore 12, while the outer peripheral cylindrical surfaces 26 of the barbs 22 are retained by the bore jag guide 34 at a spacing or clearance, indicated at C, from the surface of the rifle bore 12. This spacing is in the order of 0.005 inch.

At the end of the bore jag 16 opposite from the conical tip 20, the bore jag 16 has an externally threaded end portion 42, which is in threaded engagement with an internally threaded end portion 44 of the cleaning rod 18.

Between the end portion 42 and the bore jag guide 34, the bore jag 16 is formed with a forwardly and outwardly concavely curved, i.e. radiused, intermediate portion 46.

This intermediate portion 46 merges smoothly with the peripheral surface of the bore jag end portion 42 and, as can be seen from FIG. 2, extends in an ogee curve, without any sharp edge as far as the annular recess 40.

This smoothly curved intermediate portion 46 is provided in order to avoid damage to the muzzle crown 14 of the rifle barrel 10 when the bore jag 16 is pulled backwardly through the muzzle crown 14.

More particularly, as explained above, during the cleaning operation, a cleaning cloth (not shown), with a suitable cleaning liquid, is wrapped around the bore jag 16 before the bore jag 16 is inserted into the rifle barrel 10 from the breach end of the rifle barrel 10.

This cleaning rag serves, in addition to cleaning the rifle bore 12, to prevent engagement of the barbs 22 with the rifle barrel bore 12. If the direction of travel of the bore jag 16 along the rifle barrel 10 is reversed, before the bore jag 16 has been pushed through the muzzle crown 14 and, therefore while the cleaning cloth is still wrapped around the barbs 22, then the barbs 22 serve to engage and retain the cleaning cloth during such reverse movement of the bore jag 16.

When, however, the bore jag 16 has been inserted so far along the rifle barrel 14 from the breach end thereof, by pushing on the cleaning rod 18, that the bore jag 16 leaves the rifle barrel bore 12 through the bore crown 14, then the cleaning cloth drops from, or may be manually removed from, the bore jag 16.

When the direction of movement of the bore jag 16 is then reversed, by pulling on the cleaning rod 18, so as to cause the bore jag to return through the muzzle crown 14, it is highly important to prevent damage to the muzzle crown 14, and in particular, to the annular inner edge 48 of the muzzle crown 14, by the bore jag 16.

The avoidance of such damage is facilitated by the provision of the curved intermediate portion 46, which provides a smooth transition between the bore jag end portion 42 and the bore jag guide 34.

Figure 4:
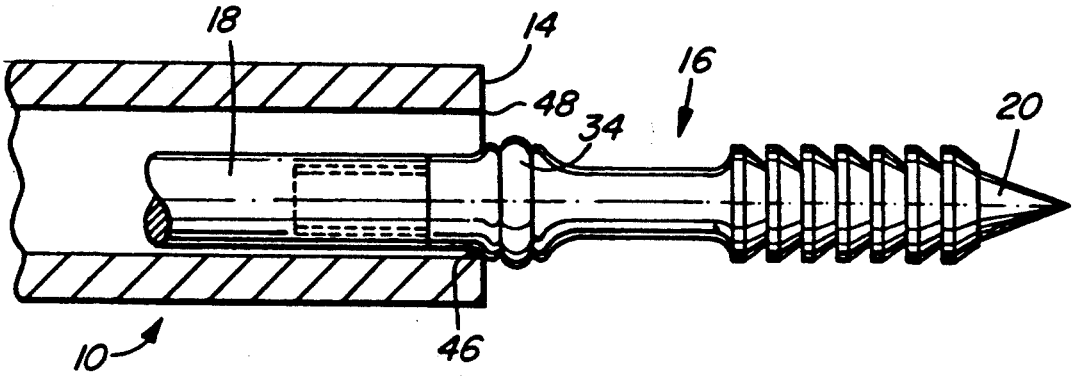
FIG. 4 shows a view corresponding to that of FIG. 1 but with the bore jag entering the rifle barrel muzzle.

More particularly, as illustrated in FIG. 4, during the return of the bore jag 16 through the muzzle crown 14, the divergent intermediate portion 46 rides smoothly over the annular inner peripheral edge 48 of the bore crown 14 and, thus, raises the bore jag 16 relative to the muzzle crown 14, and without damaging the annular edge 48, until the resilient bore jag guide 34 is brought into contact with the annular edge 48 and then rides over this annular edge 48 into sliding engagement, once more, with the bore 12 of the rifle barrel 10.

As will be apparent to those skilled in the art, various modifications may be made to the above described apparatus within the scope of the appended claims.

I claim:

1. A bore jag, comprising:

a threaded end portion at one end of said bore jag for releasibly connecting said bore jag to an end of a barrel cleaning rod;

an annular peripheral recess extending around said bore jag;

a bore jag guide for guiding said bore jag along a rifle barrel bore during use of the bore jag;

said bore jag guide comprising an O-ring of resiliently deformable material engaged in said recess, said material being sufficiently soft to avoid damage to the rifle barrel bore by the sliding engagement of the bore jag guide therewith;

said O-ring having an outer peripheral portion projecting radially outwardly from said recess for sliding contact with the surface of the rifle barrel bore; and said O-ring having an outer diameter sufficiently greater than the remainder of said bore jag to support the remainder of said bore jag out of contact with the rifle barrel bore during travel of said bore jag along the rifle barrel bore;

an intermediate portion extending from said end portion to said recess;

said intermediate portion merging smoothly with said end portion and diverging towards the outer peripheral portion of said O-ring so as to provide a smooth transition from said end portion to said recess;

a plurality of barbs distributed along said bore jag for retaining engagement with a cleaning cloth; and a shank extending between said recess and said barbs;

said shank diverging smoothly outwardly to said outer peripheral portion of said O-ring and to said barbs at opposite ends of said shank.

2. A bore jag as claimed in claim 1, wherein said barbs are all co-axially aligned, frusto-conically shaped barbs which taper away from said one end of said bore jag.

* * * * *